US007114385B2

(12) United States Patent
Fisseler et al.

(10) Patent No.: US 7,114,385 B2
(45) Date of Patent: Oct. 3, 2006

(54) APPARATUS AND METHOD FOR DRAWING FLUID INTO A DOWNHOLE TOOL

(75) Inventors: Patrick J. Fisseler, Missouri City, TX (US); Thomas W. Palmer, II, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 160 days.

(21) Appl. No.: 10/960,404

(22) Filed: Oct. 7, 2004

(65) Prior Publication Data

US 2006/0075813 A1 Apr. 13, 2006

(51) Int. Cl.
*E21B 49/10* (2006.01)

(52) U.S. Cl. ..... 73/152.26; 73/152.01

(58) Field of Classification Search ..... 73/152.26, 73/152.01, 152.18
See application file for complete search history.

(56) References Cited

U.S. PATENT DOCUMENTS 2,389,512 A * 11/1945 Humason ..... 166/100
3,173,485 A 3/1965 Bretzke et al.
3,261,402 A 7/1966 Whitter
3,577,782 A 5/1971 Altken
3,630,282 A 12/1971 Lanmon, II
3,707,195 A 12/1972 Lanmon, II
3,782,191 A 1/1974 Whitten
3,813,936 A 6/1974 Urbanosky et al.
3,859,851 A 1/1975 Urbanosky
3,864,970 A 2/1975 Bell
3,924,463 A 12/1975 Urbanosky
3,934,468 A 1/1976 Brieger
3,952,588 A 4/1976 Whitten
4,071,085 A * 1/1978 Grable et al. ..... 166/84.4
4,287,946 A 9/1981 Brieger
4,860,581 A 8/1989 Zimmerman et al.
4,936,139 A 6/1990 Zimmerman et al.
4,951,749 A 8/1990 Carroll
4,994,671 A 2/1991 Safinya et al.
5,303,775 A 4/1994 Michaels et al.
5,337,821 A * 8/1994 Peterson ..... 166/250.07
5,377,755 A 1/1995 Michaels et al.
6,192,982 B1 * 2/2001 Divis et al. ..... 166/187
6,230,557 B1 5/2001 Ciglenec et al.
6,301,959 B1 10/2001 Hrametz et al.

(Continued)

FOREIGN PATENT DOCUMENTS

WO WO 03/097999 11/2003

(Continued)

*Primary Examiner*—Daniel S. Larkin
*Assistant Examiner*—Rodney Frank
(74) *Attorney, Agent, or Firm*—Jennie Salazar; Matthias Abrell; Victor H. Segura

(57) ABSTRACT

An apparatus and method for drawing fluid from a subterranean formation into a downhole tool positioned in a wellbore penetrating the formation is provided. A probe body is extended from the downhole tool for engagement with the wellbore wall. The probe body has at least one inlet extending therethrough for receiving downhole fluids. At least one packer is positioned on an external end of the probe body and adapted to create a seal with the wellbore wall. The packer has an inner surface defining an aperture therethrough in fluid communication with the at least one inlet, and a peripheral surface. An internal packer support is positioned adjacent the inner surface of the packer, and an external packer support is positioned about the peripheral surface of the packer whereby at least a portion of the at least one packer is supported as it is pressed against the wellbore wall.

30 Claims, 8 Drawing Sheets

U.S. PATENT DOCUMENTS

| | | | |
|---|---|---|---|
| 6,388,251 | B1 | 5/2002 | Papanyan |
| 6,427,530 | B1 | 8/2002 | Krueger et al. |
| 6,435,279 | B1 | 8/2002 | Howe et al. |
| 6,467,544 | B1 | 10/2002 | Brown et al. |
| 6,568,487 | B1 | 5/2003 | Meister et al. |
| 6,585,045 | B1 | 7/2003 | Lee et al. |
| 6,609,568 | B1 | 8/2003 | Krueger et al. |
| 6,658,930 | B1 | 12/2003 | Abbas |
| 6,659,177 | B1 | 12/2003 | Bolze et al. |
| 6,719,049 | B1 | 4/2004 | Sherwood et al. |
| 6,729,399 | B1 | 5/2004 | Follini et al. |
| 6,745,835 | B1 | 6/2004 | Fields |
| 2002/0189339 | A1 | 12/2002 | Montalvo et al. |
| 2003/0042021 | A1 | 3/2003 | Bolze et al. |
| 2004/0000433 | A1 | 1/2004 | Hill et al. |
| 2004/0011525 | A1 | 1/2004 | Jones et al. |
| 2004/0079527 | A1 | 4/2004 | Meister et al. |
| 2004/0099443 | A1 | 5/2004 | Meister et al. |
| 2004/0144533 | A1 | 7/2004 | Zazovsky |
| 2004/0173351 | A1 | 9/2004 | Fox et al. |
| 2005/0161218 | A1 | 7/2005 | Van Zuilekom et al. |

FOREIGN PATENT DOCUMENTS

| | | |
|---|---|---|
| WO | WO 03/098639 | 11/2003 |
| WO | WO 2004/020982 | 3/2004 |
| WO | WO 2004/081334 | 9/2004 |

* cited by examiner

APPARATUS AND METHOD FOR DRAWING FLUID INTO A DOWNHOLE TOOL

BACKGROUND OF THE INVENTION

1. Field of the Invention

The present invention relates to techniques for establishing fluid communication between a subterranean formation and a downhole tool positioned in a wellbore penetrating the subterranean formation. More particularly, the present invention relates to probes and associated techniques for drawing fluid from the formation into the downhole tool.

2. Background of the Related Art

Wellbores are drilled to locate and produce hydrocarbons. A downhole drilling tool with a bit at an end thereof is advanced into the ground to form the wellbore. As the drilling tool is advanced, a drilling mud is pumped through the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. These samples or tests may be used, for example, to locate valuable hydrocarbons.

Formation evaluation often requires that fluid from the formation be drawn into the downhole tool for testing and/or sampling. Various devices, such as probes, are extended from the downhole tool to establish fluid communication with the formation surrounding the wellbore and draw fluid into the downhole tool. A typical probe is a circular element extended from the downhole tool and positioned against the sidewall of the wellbore. A packer at the end of the probe is used to create a seal with the wall of the formation. The mudcake lining the wellbore is often useful in assisting the packer in making the seal. Once the seal is made, fluid from the formation is drawn into the downhole tool through an inlet in the probe by lowering the pressure in the downhole tool. Examples of such probes used in wireline and/or drilling tools are described in U.S. Pat. Nos. 6,301,959; 4,860,581; 4,936,139; 6,585,045 and 6,609,568 and U.S. patent application Ser. No. 2004/0000433.

Despite the advances in probe technology, there remains a need for a reliable probe that is capable of operating in extremely harsh wellbore conditions. During operation, the seal between the packer and the wellbore wall may be incomplete or lost. When a probe fails to make a sufficient seal with the wellbore wall, problems may occur, such as contamination by wellbore fluids seeping into the downhole tool through the inlet, lost pressure and other problems. Such problems may cause costly delays in the wellbore operations by requiring additional time for more testing and/or sampling. Additionally, such problems may yield false results that are erroneous and/or unusable.

There also remains a need for a probe that routinely provides an adequate seal with the formation, particularly in cases where the surface of the well is rough and the probe may not have good contact with the wellbore wall. It is desirable that such a probe be provided with mechanisms that provide additional support to the packer to assure a good seal with the wellbore wall. Moreover, it is desirable that such a probe conforms to the shape of the wellbore, distributes forces about the probe and/or reduces the likelihood of failures.

SUMMARY OF THE INVENTION

The present invention is directed at techniques for supporting a probe of a downhole tool during formation evaluation. In at least one aspect, the present invention relates to a probe for drawing fluid from a subterranean formation into a downhole tool. The downhole tool is positioned in a wellbore penetrating the subterranean formation. The downhole tool is provided with a probe body, at least one packer and a plurality of packer supports. The probe body is extendable from the downhole tool and has at least one inlet extending therethrough for receiving downhole fluids. The packer is positioned on an external end of the probe body. The packer is adapted to create a seal with the wellbore wall. The packer has an inner surface and a peripheral surface. The inner surface defines an aperture therethrough in fluid communication with the inlet(s). At least one of the plurality of at least one packer supports is an internal packer support positioned adjacent at least a portion of the inner surface of the packer and at least one of the plurality of packer supports is an external packer support positioned about at least a portion of the peripheral surface of the packer whereby at least a portion of the packer is supported as it is pressed against the wellbore wall.

In another aspect, the invention relates to a downhole tool for drawing fluid from a subterranean formation therein. The downhole tool is positionable in a wellbore penetrating the subterranean formation. The downhole tool is provided with a housing, a probe body, at least one packer and a plurality of supports. The probe body is extendable from the housing, the probe body having at least one inlet extending therethrough for receiving downhole fluids. The packer is positioned on an external end of the probe body. The packer is adapted to create a seal with the wellbore wall. The packer has an inner surface and a peripheral surface. The inner surface defines an aperture therethrough in fluid communication with the inlet(s). At least one packer support is an internal packer support positioned adjacent at least a portion of the inner surface of the packer and at least one packer support is an external packer support positioned about at least a portion of the peripheral surface of the packer whereby at least a portion of the packer is supported as it is pressed against the wellbore wall.

Finally, in another aspect, the present invention relates to a method of drawing a fluid from a subterranean formation into a downhole tool positioned in a wellbore. The method includes extending a probe from the downhole tool, the probe having a packer at an end thereof, sealingly engaging the packer with a wall of the wellbore, supporting at least a portion of the inner surface of the packer and the peripheral surface of the packer as the packer engages the wellbore wall and drawing the fluid into the probe through the aperture. The packer has an inner surface and a peripheral surface, the inner surface defining an aperture therethrough.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
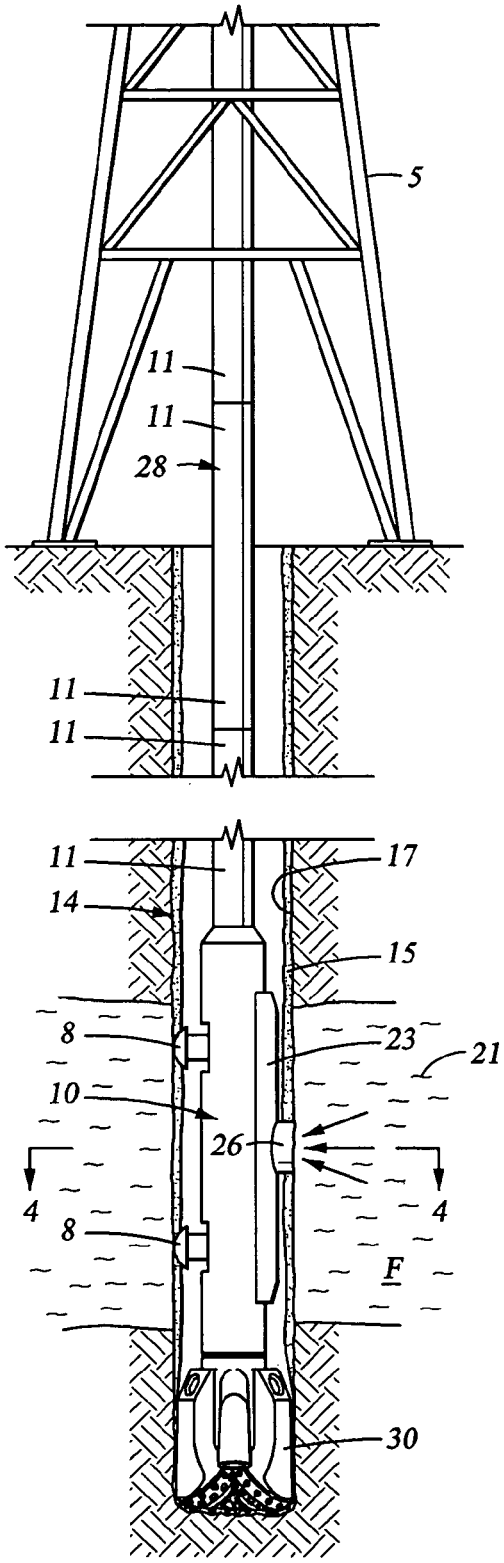
FIG. 1 is a schematic view, partially in cross-section of down hole tool with a probe in accordance with the present invention, the downhole tool being a downhole drilling tool.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Figure 2:
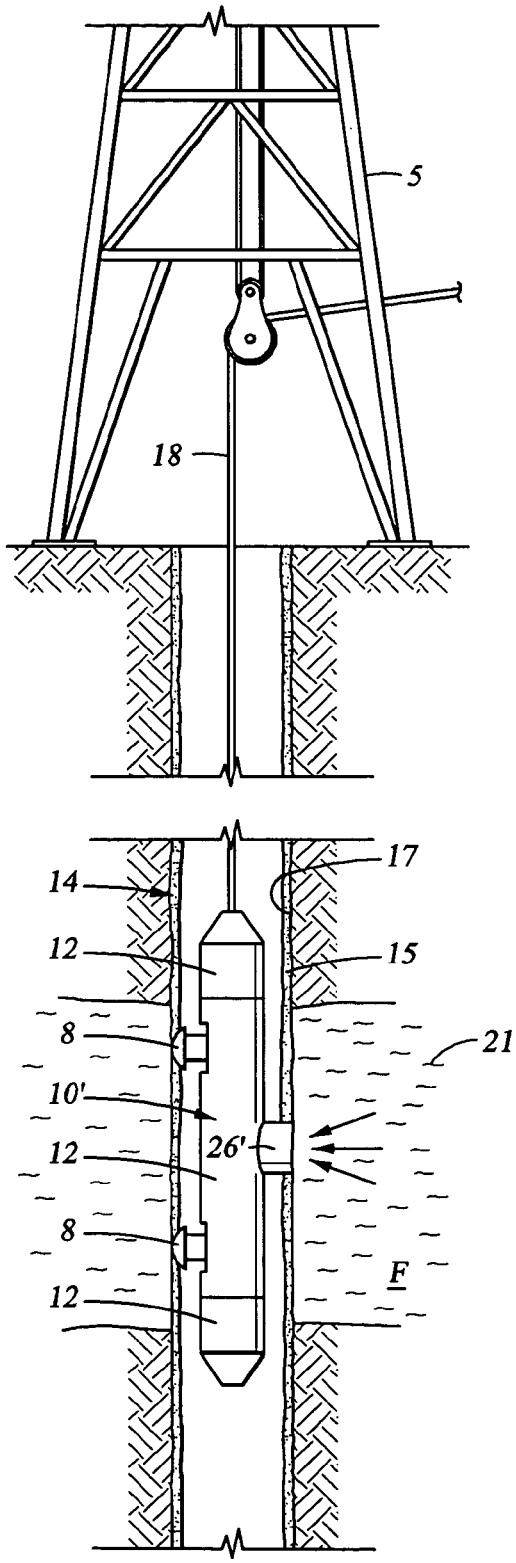
FIG. 2 is a schematic view, partially in cross-section of a downhole tool with a probe in accordance with the present invention, the downhole tool being a wireline tool.

In the illustrated example, the present invention is carried by a down hole tool, such as the drilling tool 10 of FIG. 1 or the wireline tool 10' of FIG. 2. The present invention may also be used in other downhole tools adapted to draw fluid therein, such as coiled tubing, casing drilling and other variations of downhole tools.

FIG. 1 depicts a downhole drilling tool 10 deployed from a rig 5 and advanced into the earth to form a wellbore 14. The wellbore penetrates a formation F containing a formation fluid 21. The downhole drilling tool is suspended from the drilling rig by one or more drill collars 11 that form a drill string 28. Mud is pumped through the drill string 28 and out bit 30 of the drilling tool 10. The mud is pumped back up through the wellbore and to the surface for recirculation. As the mud passes through the wellbore, it forms a mud layer or mudcake 15 along the wellbore wall 17.

The drilling tool 10 is provided with a probe 26 for establishing fluid communication with the formation F and drawing the fluid 21 into the downhole tool as shown by the arrows. As shown in FIG. 1, the probe is positioned in a stabilizer blade 23 of the drilling tool and extended therefrom to engage the wellbore wall. One or more blades and/or probes may be used.

Fluid drawn into the downhole tool using the probe 26 may be measured to determine, for example pretest and/or pressure parameters. Additionally, the downhole tool may be provided with devices, such as sample chambers, for collecting fluid samples for retrieval at the surface. Backup pistons 8 may also be provided to assist in applying force to push the drilling tool and/or probe against the wellbore wall.

The drilling tool used with the present invention may be of a variety of drilling tools, such as a Measurement-While-Drilling (MWD), Logging-While Drilling (LWD), casing drilling or other drilling system. An example of a drilling tool usable for performing various downhole tests is depicted in U.S. patent application Ser. No. 10/707,152 filed on Nov. 24, 2003, the entire contents of which are hereby incorporated by reference.

The downhole drilling tool 10 may be removed from the wellbore and a wireline tool 10' (FIG. 2) may be lowered into the wellbore via a wireline cable 18. An example of a wireline tool capable of sampling and/or testing is depicted in U.S. Pat. Nos. 4,936,139 and 4,860,581 the entire contents of which are hereby incorporated by reference.

The downhole tool 10' is deployable into bore hole 14 and suspended therein with a conventional wire line 18, or conductor or conventional tubing or coiled tubing, below the rig 5 as will be appreciated by one of skill in the art. The illustrated tool 10' is provided with various modules and/or components 12, including, but not limited to, a probe 26' for establishing fluid communication with the formation F and drawing the fluid 21 into the downhole tool as shown by the arrows. Backup pistons 8 may be provided to further thrust the downhole tool against the wellbore wall and assist the probe in engaging the wellbore wall. The tools of FIGS. 1 and 2 may be modular as shown in FIG. 2 or unitary as shown in FIG. 1 or combinations thereof.

Figure 3A:
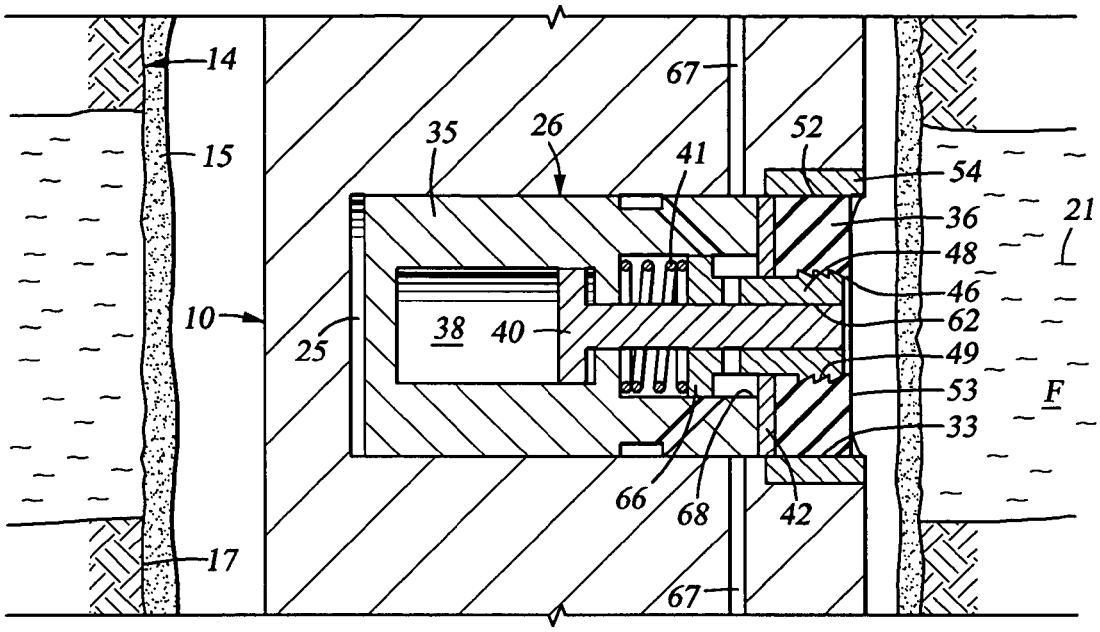
FIG. 3A is a schematic view of the downhole tool of FIG. 1 with the probe in the retracted position, the downhole tool having an external support.
Figure 3B:
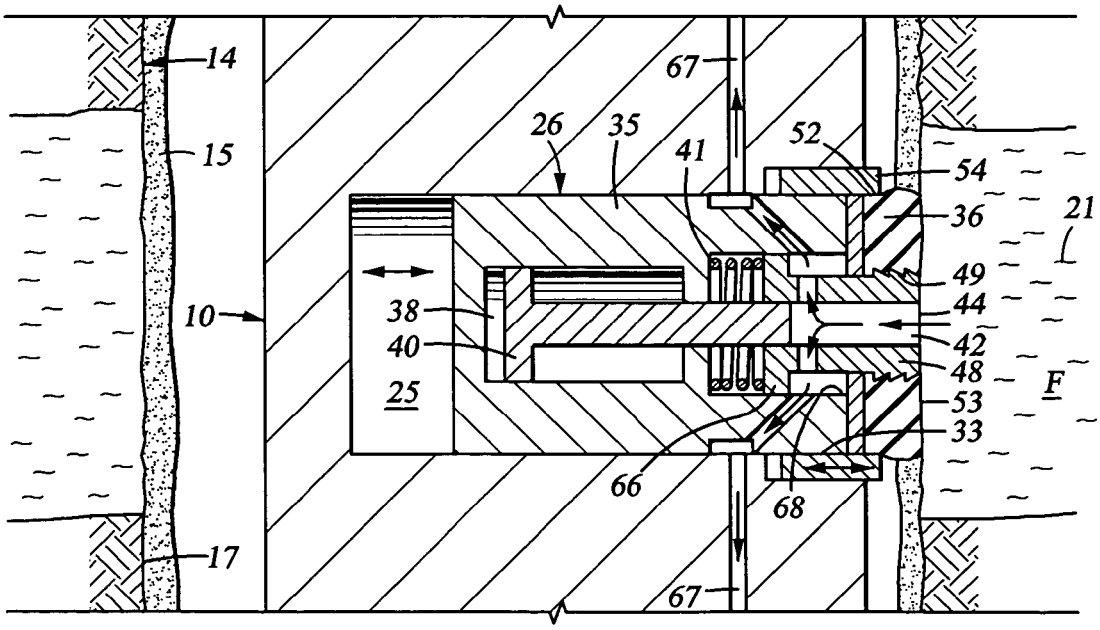
FIG. 3B is a schematic view of the downhole tool of FIG. 3A with the probe in the extended position.

FIGS. 3A and 3B schematically depict the operation of the probe 26 in greater detail. FIG. 3A depicts the probe 26 in the retracted position within the downhole tool 10, and FIG. 3B depicts the probe in the extended position adjacent the wellbore wall 17. As shown in FIGS. 3A and 3B, the probe 26 is positioned within a housing or other portion of the downhole tool and slidably movable therein using an actuator (not shown). An example of a hydraulic actuator that may be used to advantage is described in U.S. Pat. Nos. 6,230,557; 4,860,581; and 4,936,139 commonly assigned to the assignee of the present application, the entire contents of which are hereby incorporated by reference.

While FIGS. 3A and 3B depict probe 26 in the downhole tool, it will be appreciated by one of skill in the art that one or more probes could be positioned in a housing, drill collar, module or other portion of the downhole tool for extension therefrom. In some cases, it may be desirable to position the probe in a protruberance in the downhole tool, such as a stabilizer or rib as depicted in FIG. 1.

Referring back to FIG. 3A, in the retracted position, the probe 26 is preferably receded within a chamber 25 of the downhole tool. During non-operation, the probe 26 is preferably positioned within the downhole tool to prevent damage to the probe as the tool passes through the wellbore. When activated to perform an operation, the probe is slidably moved by the actuator to the extended position (FIG. 3B) as indicated by the arrows. In the extended position, a portion of the packer extends through an opening 33 in the downhole tool. A portion of the packer extends a distance beyond the downhole tool for engagement with the wellbore wall 17 and mudcake 15. Preferably, in the extended position, a portion of the probe remains in the downhole tool, and a portion of the probe extends beyond an outer surface of the downhole tool.

Figure 4A:
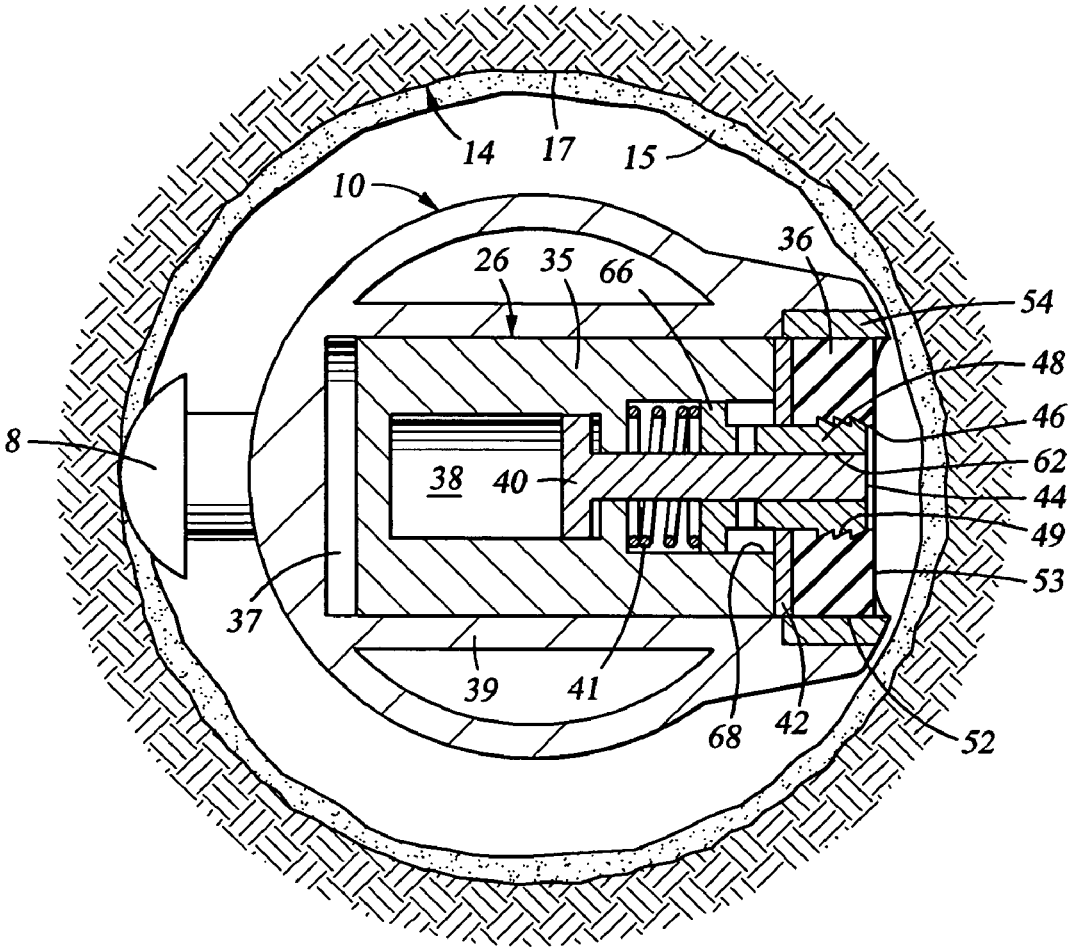
FIG. 4A is a horizontal cross-sectional view of the downhole tool of FIG. 1 taken along line 4—4.
Figure 4B:
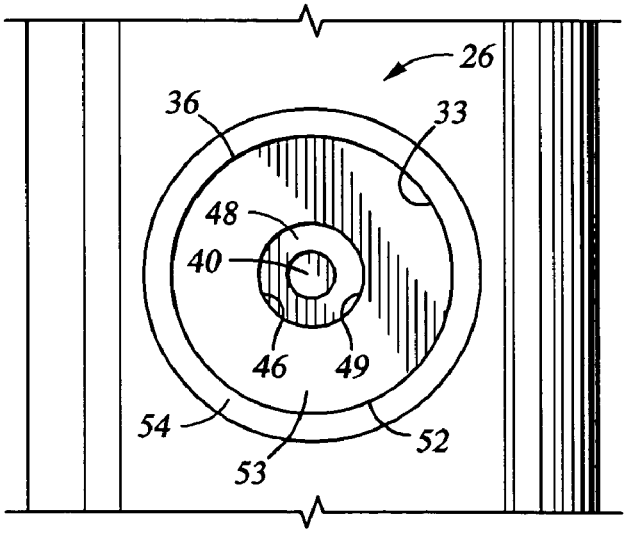
FIG. 4B is a plan view of the downhole tool of FIG. 1 depicting the exterior of the probe.

An alternate view of the probe 26 is shown in FIGS. 4A and 4B. FIG. 4A is a horizontal cross-section of the drilling tool 10 of FIG. 1 taken along line 4—4 and in the retracted position. The probe 26 has a probe body 35 with packer 36 at an end thereof adapted to form a seal with the wellbore wall. The probe body 35 is slidably movable within a chamber 25 in the downhole tool. The probe body has an outer surface that acts as a platform 42 to support the packer 36. As depicted in FIG. 4A, the chamber 25 is within a chassis 39 of a drill collar of a downhole drilling tool, but could be in any type of housing or configuration.

The probe body has an internal chamber 38 with a retractable piston 40 slidably positioned therein. The retractable piston 40 is selectively retractable into the probe body 35 to define a cavity 42 (FIG. 3B) for receiving formation fluid. In the extended position (FIGS. 3A and 4A), the retractable piston 40 prevents fluid and debris from entering the cavity. The cavity extends from an inlet 44 in the probe body and through an aperture 46 of the packer 36.

Referring back to FIGS. 4A and 4B, the packer 36 is preferably made of an elastomeric material, such as rubber, adapted to conform to the wellbore wall and seal with the mudcake. The packer is preferably a cylindrical or doughnut shaped rubber pad that is pressed against the wellbore wall to form the desired seal, although other geometries may be used. The packer has an inner surface 49 defining an aperture 46 therethrough for passage of fluids. The packer also has an peripheral surface 52 extending from the platform 42 of the probe to a top surface 53 of the packer. The packer may be inflated with fluid, as described for example in U.S. Pat. Nos. 4,860,581; and 4,936,139 commonly assigned to the assignee of the present application and previously incorporated by reference herein.

When the probe is extended and the packer is pressed against the wellbore wall, the packer typically deforms and flattens against the wall. However, as shown in FIG. 3B, the probe is provided with one or more supports 48, 54 that act as buttresses to support the packer and/or to assist in preventing the packer from deforming. These supports extend along at least a portion of the adjacent surface of the packer to provide support thereto. External support 54 is positioned about the peripheral surface 52 of the packer. As shown in FIG. 3B, the external support 54 is positioned in the downhole tool 10 and selectively extendable with the probe to provide support about the peripheral surface thereof.

Figure 5:
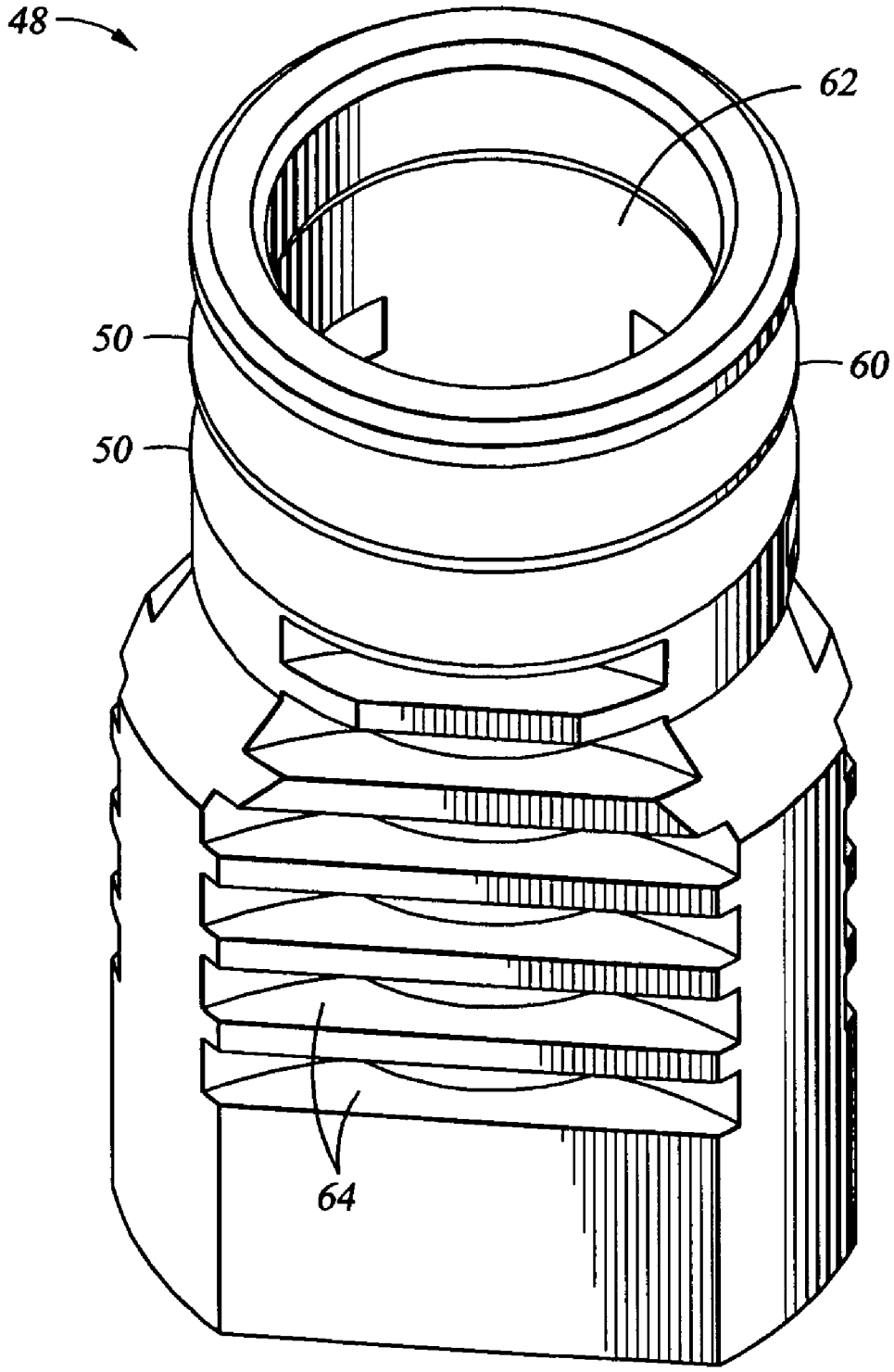
FIG. 5 is a three-dimensional view of an internal support of the probe of FIG. 3A.

Internal support 48 is positioned along the inner surface 49 of the packer. The internal support 48 is shown in greater detail in FIG. 5. Internal support 48 is preferably a tubular member having an outer surface 60 insertable into the aperture 46 of the packer to line and support the inner surface 49. The internal support 48 is preferably provided with a plurality of barbs 50 (or other anchoring device, such as grooves) positioned along the outer surface 60 for engagement with inner surface 49 of the packer 36. These barbs are preferably configured to provide anchoring and/or locking features that allow the internal support to anchor itself to the inner surface of the packer and prevent the internal support from deforming as the packer is pressed against the wellbore wall.

Referring back to FIGS. 3A and 3B, the internal support 48 also has an inner surface 62 adapted to receive the piston 40. The internal surface may be provided with a separate or integral base 66 slidably movable within a chamber 68. A spring 41 may be provided to apply a force to the base 66. Alternatively, the internal support may be with or connectable to the platform 42 of probe body 35.

Optionally, the internal support may be provided with one or more apertures 64(FIG. 5) for passing fluid therethough into the downhole tool. The apertures are preferably positioned such that when the internal support is retracted, the apertures are exposed to cavity 42 and permit fluid to pass from the cavity into a flowline 67. In operation, the piston 40 is retracted and fluid passes from the formation, into cavity 42, through the apertures 64, through the probe body 35 and into the downhole tool 10 as depicted by the arrows (FIG. 3B). In some cases, one or more flowlines 67 in the downhole tool may be fluidly connected to the chamber 66 for passing the fluid to other portions of the downhole tool, such as an internal sample chamber (not shown), or through an outlet to the wellbore.

Referring still to FIGS. 3A and 3B, an external support 54 is positioned along the opening 33 of the downhole tool. The external support may be positioned in a pocket about the opening 33, or integral with the downhole tool. The external support is positioned adjacent a peripheral surface 52 of the packer 36 to provide external support thereto. The packer preferably fit snugly within the downhole tool such that, when extended, a portion of the packer remains in contact with the external support. In this manner, the external support assists in preventing the packer from deforming as it is pressed against the wellbore wall.

The external support 54 may be extendable from the downhole tool as indicated by the arrows. The external support may be extended to provide support over a greater portion of the peripheral surface of the packer when the probe is in the extended position. An actuator, for example a spring or hydraulic mechanism, may be used to selectively extend the external support the desired distance from the downhole tool.

In operation, as shown in FIGS. 3A and 3B, as the probe is pressed against the wall, the elastomeric material tends to flatten and deform. The internal and external supports are positioned about the packer to assist in preventing such deformation as the packer is extended and pressed against the wellbore wall. As the probe and its packer are extended, the internal and external supports extend with the packer to provide additional support along the inner surface of the packer. The internal and external supports may be configured to provide support to the desired amount of surface area of the packer adjacent thereto.

Figure 6A:
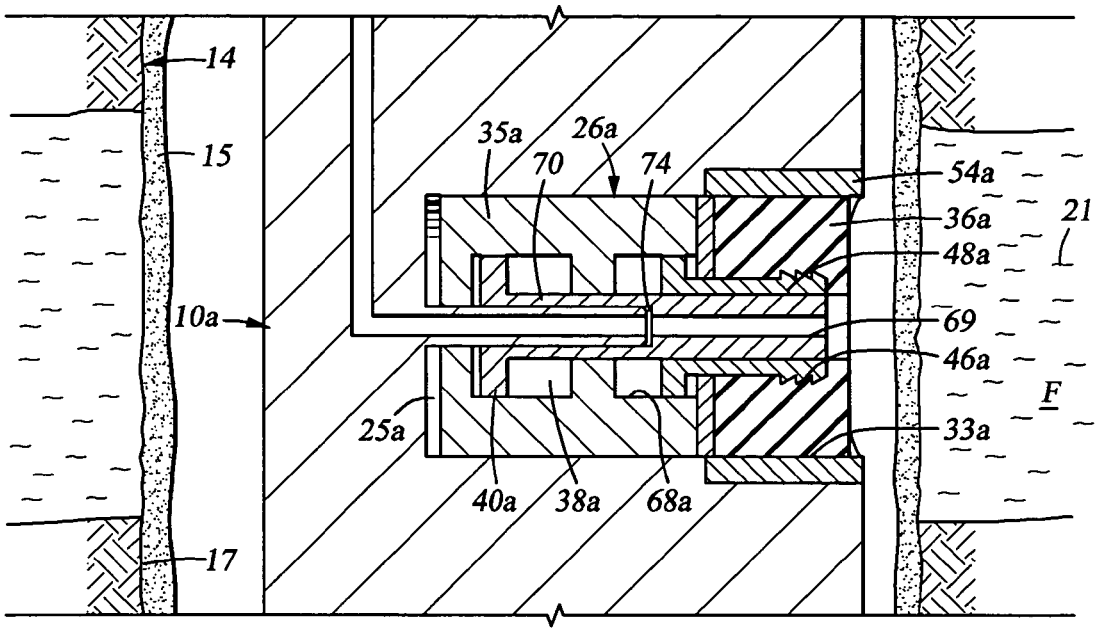
FIG. 6A is a schematic view of an alternate embodiment of the downhole tool of FIG. 1 with the probe in the retracted position, the downhole tool having a movable exterior support.
Figure 6B:
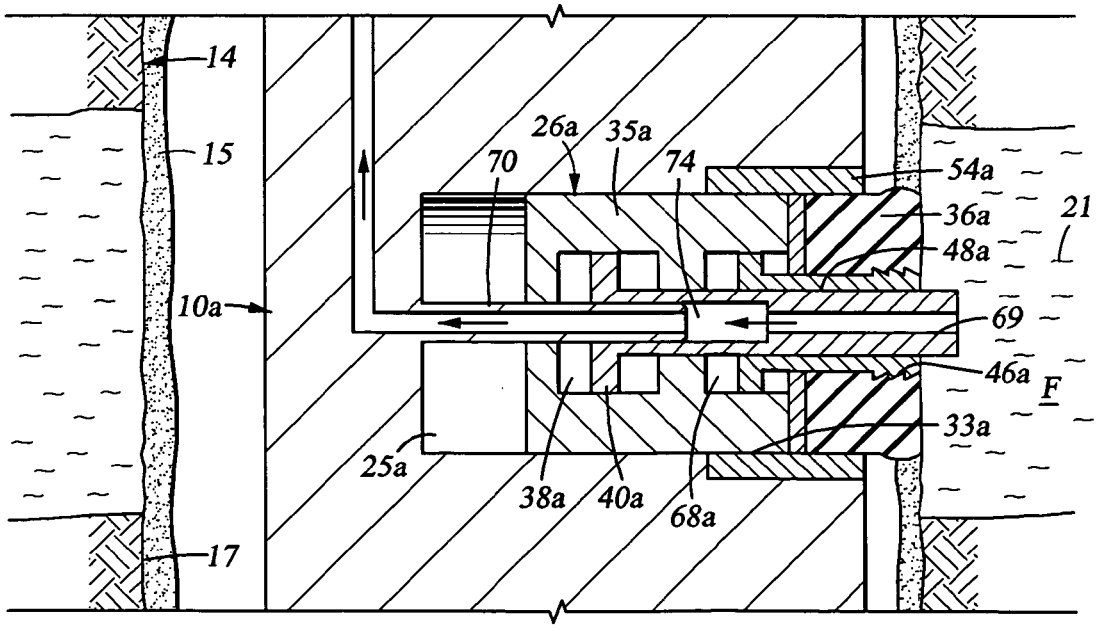
FIG. 6B is a schematic view of the downhole tool of FIG. 6A with the probe in the extended position.

An alternate embodiment of the downhole tool 10*a* and probe 26*a* of FIG. 1 are shown in FIGS. 6A and 6B. The probe 26*a* is in the retracted position in FIG. 6A, and in the extended position in FIG. 6B. In this embodiment, the probe 26*a* has a probe body 35*a* with a packer 36*a*, and an extendable piston 40*a*. The probe 35*a* is positioned in a chamber 25*a* and slidably movable therein, and extends through opening 33*a* in the downhole tool 10*a*. The piston 40*a* is positioned in a chamber 38*a* and is slidably movable therein. The piston 40*a* has a passage 69 extending therethrough. A flowline 70 extends from the downhole tool 10, into chamber 38*a* of piston body 35*a* and into a cavity 74 in piston 40*a*. Piston 40*a* telescopically moves along flowline 70 to permit fluid communication between passage 69 and the flowline 70 as the piston slidably moves between the extended and retracted position. Fluid may pass through flowline 70 and into the downhole tool.

The piston 40*a* may selectively move within the probe 26*a* such that it may be positioned at various locations relative to the probe. For example, the piston may be retracted within the probe as depicted in FIG. 3B, positioned flush with the probe as depicted in FIGS. 3A and 6A or extended beyond the probe 26*a* as depicted in FIG. 6B.

Internal support 48*a* is positioned along an inner surface 46*a* of packer 36*a*. In this embodiment, the internal support is a unitary piece slidingly movable within chamber 68*a* of piston body 35*a*. The internal support 48*a* has an inner surface 62*a* adapted to slidingly receive the piston 40*a*. A hydraulic actuator may be used to apply a force to internal support 48*a* to selectively advance and/or retract the internal support 48*a*. As will be described with respect to FIGS. 7A and 7B, other devices, such as a spring may also be used to urge the internal support into the advanced position.

External support 54*a* of FIGS. 6A and 6B is positioned in the downhole drilling tool. This external support remains stationary within the downhole tool as the probe is extended therefrom. The packer 36*a* is preferably snugly fit within the external support 54*a* such that at least a portion of the external support contacts at least a portion of the peripheral surface 52*a* as the probe engages the wellbore wall. These figures demonstrate that a fixed external support may be used if desired.

Figure 7A:
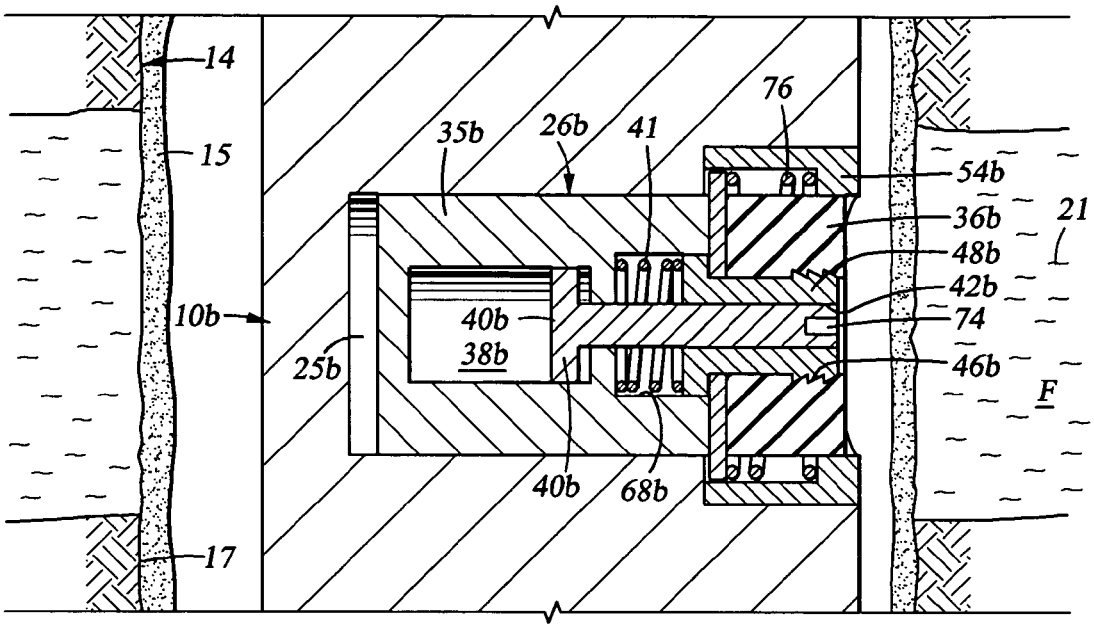
FIG. 7A is a schematic view of an alternate embodiment of the downhole tool of FIG. 1 with the probe in the retracted position, the probe having an exterior support.
Figure 7B:
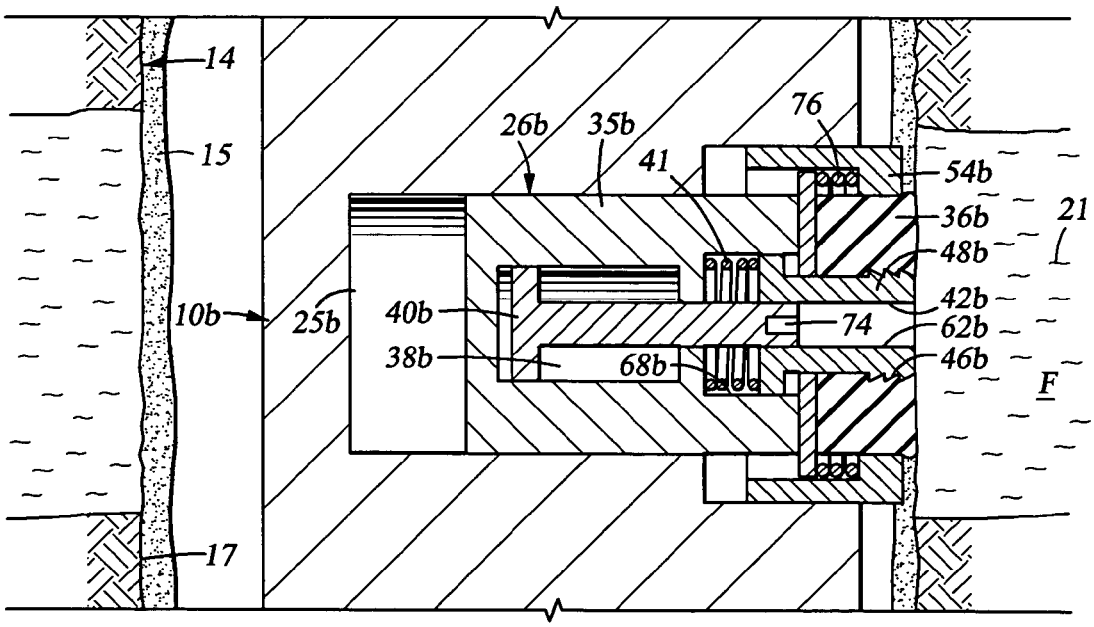
FIG. 7B is a schematic view of the downhole tool of FIG. 7A with the probe in the extended position.

Another embodiment of the downhole tool 10*b* and probe 26*b* of FIG. 1 are shown in FIGS. 7A and 7B. The probe 26*b* is in the retracted position in FIG. 7A, and in the extended position in FIG. 7B. In this embodiment, the probe 26*b* has a probe body 35*b* with a packer 36*b*, and a retractable piston 40*b*. The piston 40*b* is positioned in a chamber 38*b* and slidably movable therein. The piston 40*b* has a sensor therein 74 for measuring downhole parameters. Piston 40*b* is selectively retractable within probe 26*a* to define cavity 42*b* for receiving downhole fluids.

When in the engaged position of FIG. 7B, the piston 40*b* may selectively retracted within the probe 26*b* for drawing fluid from the formation into cavity 42*b*. Sensor 74 may be used to perform downhole measurements, such as formation pressure measurements.

Internal support 48*b* is positioned along an inner surface 46*b* of packer 36*b*. In this embodiment, the internal support is a unitary piece slidingly movable within chamber 68*b* of piston body 35*a*. Spring 41 assists in selectively extending internal support 46*b* during operation. The internal support 48*b* has an inner surface 62*b* adapted to slidingly receive the piston 40*b*.

External support 54*b* of FIGS. 7A and 7B is positioned on the probe body 35*b*. This external support is, therefore, movable with the probe body as it extends and retracts. As depicted, the external support has a spring 76 to selectively extend and retract the external support. The spring may be used to move the external support along the peripheral surface of the packer and provide support thereto. Alternatively, the external support may be fixed to the probe body about the peripheral surface of the packer.

Figure 8A:
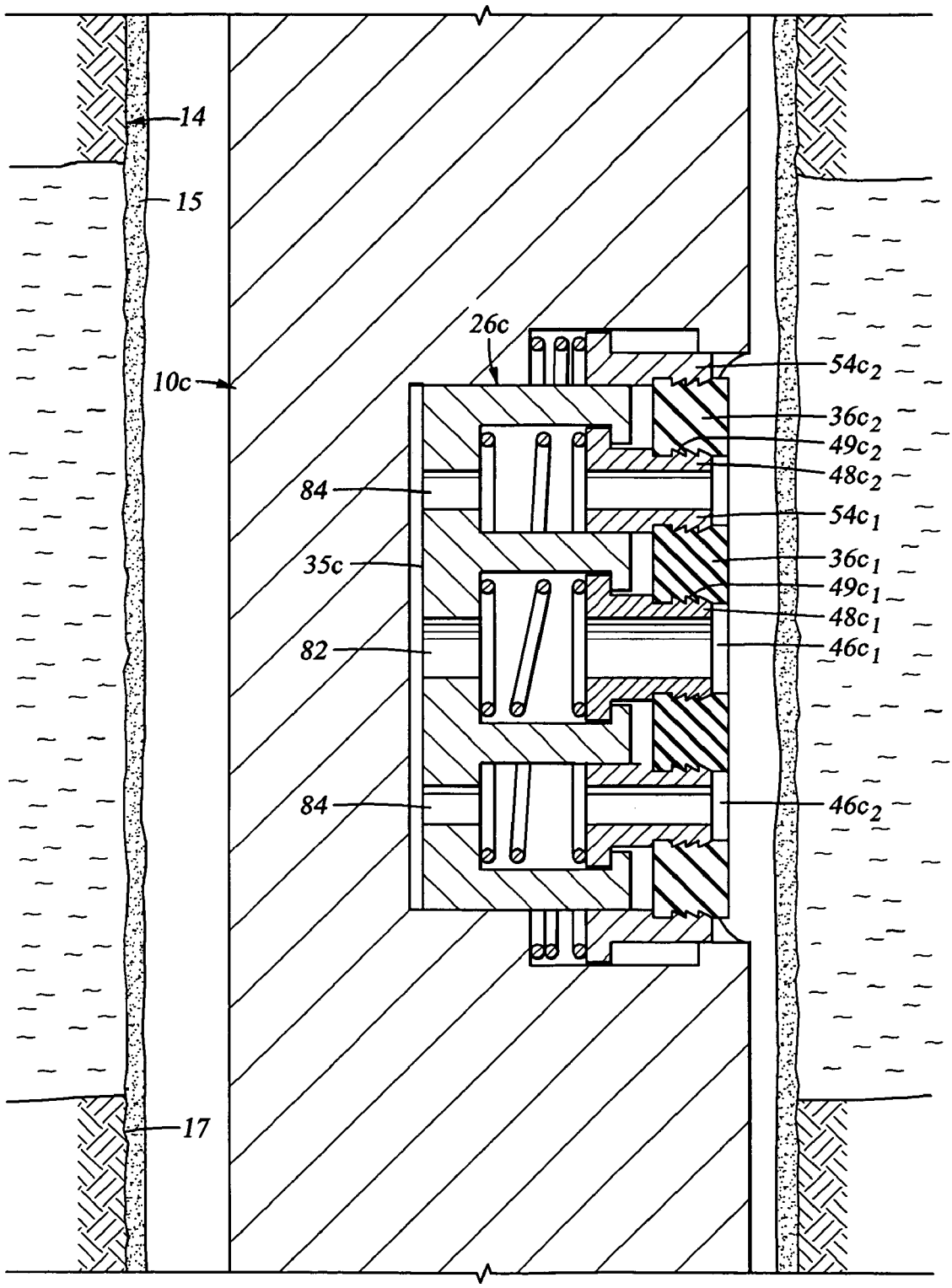
FIG. 8A is a schematic view of an alternate embodiment of the downhole tool of FIG. 1 with the probe in the retracted position, the probe having multiple packers.
Figure 8B:
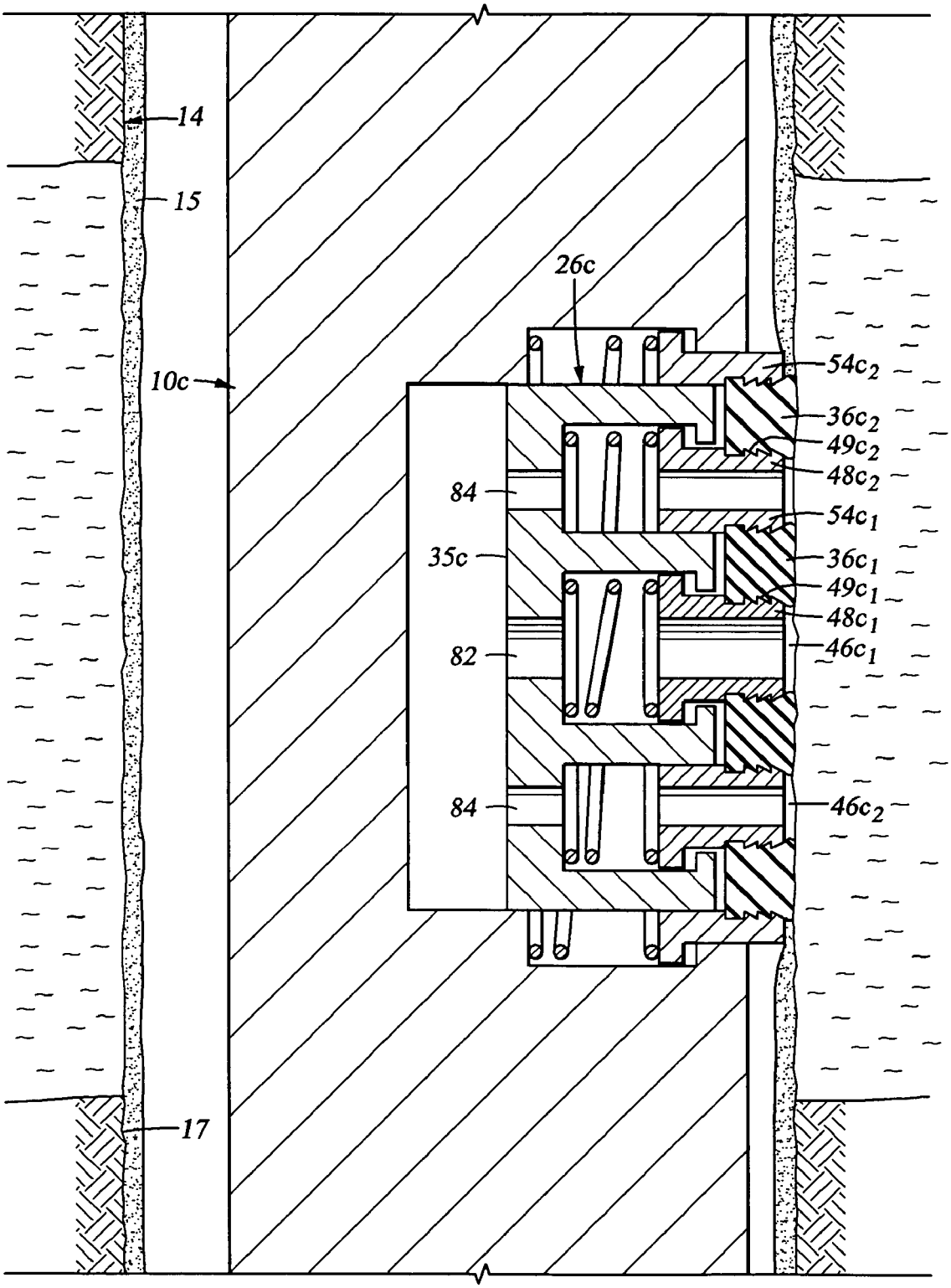
FIG. 8B is a schematic view of the downhole tool of FIG. 8A with the probe in the extended position.

FIGS. 8A and 8B depict another embodiment of a downhole tool 10*c* with a probe 26*c*. The probe 26*c* is in the retracted position in FIG. 8A, and in the extended position in FIG. 8B. In this embodiment, the probe 26*c* has a probe body 35*c* with two packers 36*c*1 and 36*c*2 on an external end thereof. The packers 36*c*1 has an inner surface 49*c*1 defining an aperture 46*c*1 therethrough, and packer 36*c*2 has an inner surface 49*c*2 defining an aperture 46*c*2 therethrough. Packer 36*c*1 is positioned within aperture 46*c*2 of packer 36*c*2. Aperture 46*c*1 is in fluid communication with a first flowline 82, and aperture 46*c*2 is in fluid communication with a second flowline 84. As shown in FIG. 8B, fluid from the formation flows into the apertures 46*c*1 and 46*c*2 and may flow into separate flowlines.

Packer 36*c*1 is provided with an internal support 48*c*1 and an external support 54*c*1. Packer 36*c*2 is provided with an internal support 48*c*2 and an external support 54*c*2. As shown in FIGS. 8A and 8B, internal support 48*c*2 is integral with external support 54*c*1. However, it will be appreciated that they could optionally be separate or connected.

As indicated in the other embodiments, the probe may be provided with pistons, sensors, filters and other devices for selectively drawing fluid into the downhole tool. Additionally, each support may be selectively movable along the adjacent surfaces of the packer, or fixed relative thereto.

It will be understood from the foregoing description that various modifications and changes may be made in the preferred and alternative embodiments of the present invention without departing from its true spirit. For example, the internal and/or external support may remain fixed as the probe extends, or extend with the probe. When extendable, the supports may be telescopically extended, spring loaded, and adjustable. The external support may be connected to the downhole tool and/or the probe. Various combinations of the supports and the amount of surface area contact with the packer are envisioned.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A probe for drawing fluid from a subterranean formation into a downhole tool, the downhole tool positioned in a wellbore penetrating the subterranean formation, comprising:

a probe body extendable from the downhole tool, the probe body having at least one inlet extending therethrough for receiving downhole fluids;

at least one packer positioned on an external end of the probe body, the at least one packer adapted to create a seal with the wellbore wall, the at least one packer having an inner surface and a peripheral surface, the inner surface defining an aperture therethrough in fluid communication with the at least one inlet; and a plurality of packer supports, at least one of the plurality of packer supports is an internal packer support positioned adjacent at least a portion of the inner surface of the at least one packer and at least one of the plurality of packer supports is an external packer support positioned about at least a portion of the peripheral surface of the at least one packer whereby at least a portion of the at least one packer is supported as it is pressed against the wellbore wall.

2. The probe af claim 1 further comprising a piston slidably positioned in a chamber of the probe body and extending into the inlet.

3. The probe of claim 2 wherein the piston is selectively retractable within the probe body to define a cavity for receiving a fluid through the inlet.

4. The probe of claim 3 further comprising a sensor for measuring parameters of the fluid.

5. The probe of claim 2 where in the piston has a passage therethrough positionable in fluid communication with a flowline of the downhole tool.

6. The probe of claim 2 wherein the piston is extendable beyond an outer surface of the packer.

7. The probe of claim 2 wherein the internal packer support is a hollow tube, the piston slidably movable therethrough.

8. The probe of claim 1 wherein the internal packer support has a plurality of barbs adapted to engage the inner surface of the packer.

9. The probe of claim 1 wherein the external support is operatively connected to the probe body.

10. The probe of claim 1 wherein at least one of the plurality of supports is selectively extendable.

11. The probe of claim 1 wherein the at least one packer comprises a central packer and a surrounding packer, the central packer disposed within the aperture of the surrounding packer such fluid flowing through the aperture of the central packer is isolated from fluid passing through the aperture of the surrounding packer.

12. A downhole tool for drawing fluid from a subterranean formation therein, the downhole tool positionable in a wellbore penetrating the subterranean formation, comprising:

a housing;

a probe body extendable from the housing, the probe body having at least one inlet extending therethrough for receiving downhole fluids;

at least one packer positioned on an external end of the probe body, the at least one packer adapted to create a seal with the wellbore wall, the at least one packer having an inner surface and a peripheral surface, the inner surface defining an aperture therethrough in fluid communication with the at least one inlet; and a plurality of packer supports, at least one of the plurality of packer supports is an internal packer support positioned adjacent at least a portion of the inner surface of the at least one packer and at least one of the plurality of packer supports is an external packer support positioned about at least a portion of the peripheral surface of the at least one packer whereby at least a portion of the at least one packer is supponed as it is pressed against the wellbore wall.

13. The downhole tool of claim 12 further comprising a piston slidably positioned in a chamber of the probe body and extending into the inlet.

14. The downhole tool of claim 13 wherein the piston is selectively retractable within the probe body to define a cavity for receiving a fluid through the inlet.

15. The dowuhole tool of claim 14 further comprising a sensor for measuring parameters of the fluid.

16. The downhole tool of claim 13 wherein the piston has a passage therethrough positionable in fluid communication with a flowline in the housing.

17. The downhole tool of claim 13 wherein the piston is extendable beyond an outer surface of the packer.

18. The downhole tool of claim 13 wherein the internal packer support is a hollow tube, the piston slidably movable therethrough.

19. The downhole tool of claim 12 wherein the internal packer support has a plurality of barbs adapted to engage the inner surface of the packer.

20. The downhole tool of claim 12 wherein the external support is operatively connected to the probe body.

21. The downhole tool of claim wherein the external support is operatively connected to the housing.

22. The downhole tool of claim 12 wherein at least one of the plurality of supports is selectively extendable.

23. The downhole tool of claim 12 wherein the at least one packer comprises a central packer and a surrounding packer, the central packer disposed within the aperture of the surrounding packer such fluid flowing through the aperture of the central packer is isolated from fluid passing through the aperture of the surrounding packer.

24. The downhole tool of claim 12 wherein the downhole tool is one of a drilling tool, a wireline tool, and a coiled tubing tool.

25. The downhole tool of claim 12 wherein the housing is one of a drill collar, a stabilizer blade, a rib, a module and combinations thereof.

26. A method of drawing a fluid from a subterranean formation into a downhole tool positioned in a wellbore, the method comprising:

extending a probe from the downhole tool, the probe having at least one packer at an end thereof, the at least one packer having an inner surface and a peripheral surface, the inner surface defining an aperture therethrough;

sealingly engaging the at least one packer with a wall of the wellbore;

supporting at least a portion of the inner surface of the packer and the peripheral surface of the at least one packer with a packer support as the at least one packer engages the wellbore wall; and drawing the fluid into the probe through the aperture.

27. The method of claim 26 further comprising measuring parameters of the fluid.

28. The method of claim 26 wherein the fluid is drawn into the probe by retracting a piston positioned in the probe.

29. The method of claim 26 further comprising extending a piston positioned in the probe through the wellbore wall.

30. The method of claim 26 wherein the step of supporting comprises grippingly engaging at least a portion of the inner surface of the at least one packer and the peripheral surface of the at least one packer as the packer engages the wellbore wall.

* * * * *